US008721459B2

(12) United States Patent
Pelkey

(10) Patent No.: US 8,721,459 B2
(45) Date of Patent: May 13, 2014

(54) MULTI-STAGE PUSH BUTTON RELEASE BATON

(75) Inventor: Gary L. Pelkey, Rindge, NH (US)

(73) Assignee: Starkey Industries, LLC, Fitzwilliam, NH (US)

( * ) Notice: Subject to any disclaimer, the term of this patent is extended or adjusted under 35 U.S.C. 154(b) by 125 days.

(21) Appl. No.: 13/323,855

(22) Filed: Dec. 13, 2011

(65) Prior Publication Data

US 2013/0150167 A1 Jun. 13, 2013

(51) Int. Cl.
*F41B 15/02* (2006.01)

(52) U.S. Cl.
USPC ..... 463/47.7

(58) Field of Classification Search
USPC ..... 463/47.2, 47.7; 135/75; 15/144.4
See application file for complete search history.

(56) References Cited

U.S. PATENT DOCUMENTS

| | | | | | |
|---|---|---|---|---|---|
| 116,097 | A | | 6/1871 | Reichard | |
| 4,037,839 | A | * | 7/1977 | Nelson | 463/47.7 |
| 4,132,409 | A | | 1/1979 | Taylor | |
| 4,135,719 | A | * | 1/1979 | Braunhut | 463/47.7 |
| 4,456,255 | A | * | 6/1984 | Braunhut | 463/47.7 |
| 4,522,398 | A | | 6/1985 | Swartz et al. | |
| 4,703,932 | A | | 11/1987 | Kubota | |
| 4,982,960 | A | | 1/1991 | David | |
| 5,031,827 | A | * | 7/1991 | von Braunhut | 231/3 |
| 5,085,433 | A | | 2/1992 | Parsons | |
| 5,108,097 | A | | 4/1992 | Ashihara | |
| 5,356,139 | A | * | 10/1994 | Parsons | 463/47.7 |
| 5,372,363 | A | * | 12/1994 | Siddle | 463/47.7 |
| 5,529,300 | A | | 6/1996 | Frazier et al. | |
| 5,568,922 | A | * | 10/1996 | Siddle | 463/47.7 |
| 5,647,591 | A | | 7/1997 | Parsons | |
| 5,690,552 | A | * | 11/1997 | Siddle | 463/47.7 |
| 5,947,352 | A | | 9/1999 | Parsons | |
| 5,965,839 | A | | 10/1999 | Vasel et al. | |
| 6,026,990 | A | | 2/2000 | Brunswig | |
| 6,070,987 | A | | 6/2000 | Jarvik | |
| H1947 | H | | 3/2001 | Starrett | |
| 6,223,441 | B1 | | 5/2001 | Parsons | |
| 6,231,447 | B1 | * | 5/2001 | Pelkey | 463/47.7 |
| 6,238,292 | B1 | * | 5/2001 | Pelkey | 463/47.7 |
| 6,386,726 | B1 | | 5/2002 | Macierowski et al. | |
| 6,463,688 | B1 | | 10/2002 | Idehara | |
| 6,499,855 | B1 | | 12/2002 | Kukuk | |
| 6,543,365 | B1 | | 4/2003 | Vasel et al. | |
| 6,615,622 | B2 | | 9/2003 | MacAleese et al. | |
| 6,761,639 | B2 | | 7/2004 | Todd | |
| 7,194,960 | B2 | | 3/2007 | Vasel | |
| 7,488,255 | B2 | * | 2/2009 | Labes | 463/47.7 |
| 2002/0144446 | A1 | | 10/2002 | Lindahl | |
| 2005/0082321 | A1 | | 4/2005 | Macierowski et al. | |
| 2007/0087844 | A1 | * | 4/2007 | Labes | 463/47.2 |
| 2008/0078796 | A1 | | 4/2008 | Parsons | |

* cited by examiner

*Primary Examiner* — William Pierce
(74) *Attorney, Agent, or Firm* — Banner & Witcoff, Ltd.

(57) ABSTRACT

The present invention provides a push button release police baton in which the collapse of the extended sections into the larger handle section is accomplished by the use of a single axially positioned push button clutch alignment rod which aligns the clutch locking mechanisms located in the extended sections and releases the sections for collapse into the handle end section of the baton.

19 Claims, 6 Drawing Sheets

'447 Prior Art

'292 Prior Art

MULTI-STAGE PUSH BUTTON RELEASE BATON

FIELD OF THE INVENTION

This invention relates to a new and improved multi-stage push button release expandable police baton. Police batons are used by police for crowd control and other police duties in place of the conventional wooden clubs. Such batons are also used as intermediate impact weapons by security personnel and the like.

BACKGROUND OF THE INVENTION

One known push button release baton is shown in U.S. Pat. No. 6,231,447. This baton uses a dual cam mechanism to allow the extended baton sections to collapse. Another known push button release baton is show in U.S. Pat. No. 6,238,292. This baton uses a ball bearing locking mechanism to hold the baton segments in the extended position. The disclosures of these patents are hereby incorporated herein by reference.

SUMMARY OF THE INVENTION

The present invention provides a new and improved push button release police baton. In particular, the collapse of the extended sections into the larger tubular section is accomplished by the use of a single axially positioned push button clutch alignment rod which aligns the clutch locking mechanisms located in the extended sections and releases the sections for collapse into the handle end section of the baton.

The baton of this invention can comprise two, three, four, five, or more telescoping stages or sections. In a preferred embodiment the baton has three telescoping sections. Each section successively gets smaller in diameter with the smaller sections telescoping into and out of larger section in which they are slidably positioned. The basic component parts of multi-stage batons are well known, and these parts can be employed in the present invention. The locking mechanism is the key to this invention.

In the preferred three stage embodiment, the middle section and the smaller inner section are moved outwardly until they are locked in place by a clutch locking mechanism when each of the sections are fully extended. To cause the collapse of the sections into one another, a push button on the handle end section is depressed to cause an axially positioned clutch alignment rod to disengage a first clutch locking mechanism holding the middle section to permit it to telescope into the larger end section. While the middle section is telescoping into the larger diameter end section, a second clutch locking mechanism holding the smaller section in place relative to the middle section is caused to disengage by the tip of the clutch alignment rod so that the smaller end section may telescope into the middle section.

The baton sections may be made out of any material suitable for the intended use of the baton. For instance, strong plastics may be suitable for some parts and/or some intended uses of the baton. Preferably, one or more metals such as steel, aluminum or any combination thereof may be employed for some or most of the parts of the baton. One preferred steel is an alloy steel such as 4130. The steel may be hardened if desired, for example to 38 to 52 as measured on the Rockwell C Scale, using conventional heat treating process which produce martensite or bainite steel. A preferred aluminum is 6061 or 7075.

BRIEF DESCRIPTION OF THE DRAWINGS

The foregoing and other features and advantages of the present invention will be more fully understood from the following detailed description the invention, taken in conjunction with the accompanying drawings in which.

DETAILED DESCRIPTION OF THE PREFERRED EMBODIMENTS

Figure 1:
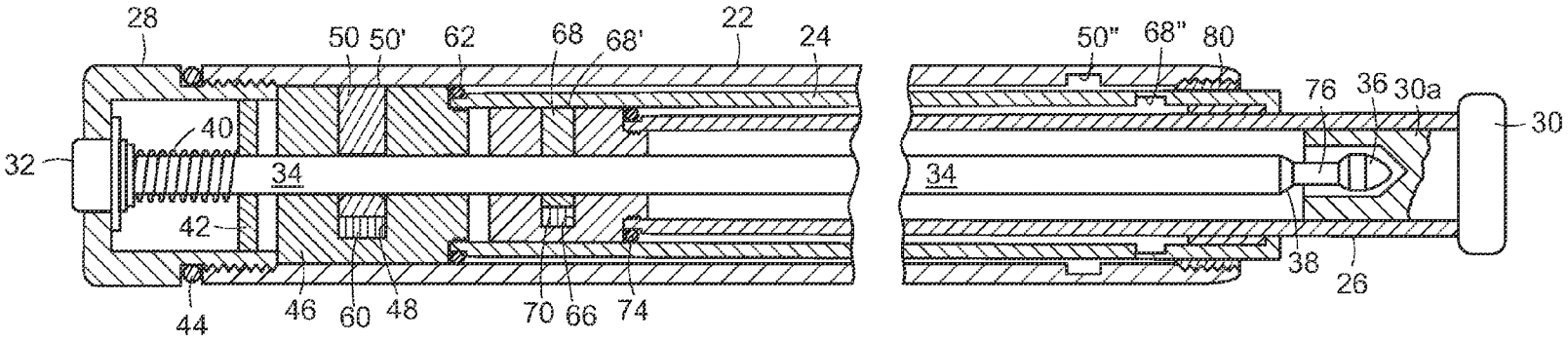
FIG. 1 is a cross-sectional view of a push button release baton of the prior art, namely the baton of U.S. Pat. No. 6,231,447 ('447).
Figure 2:
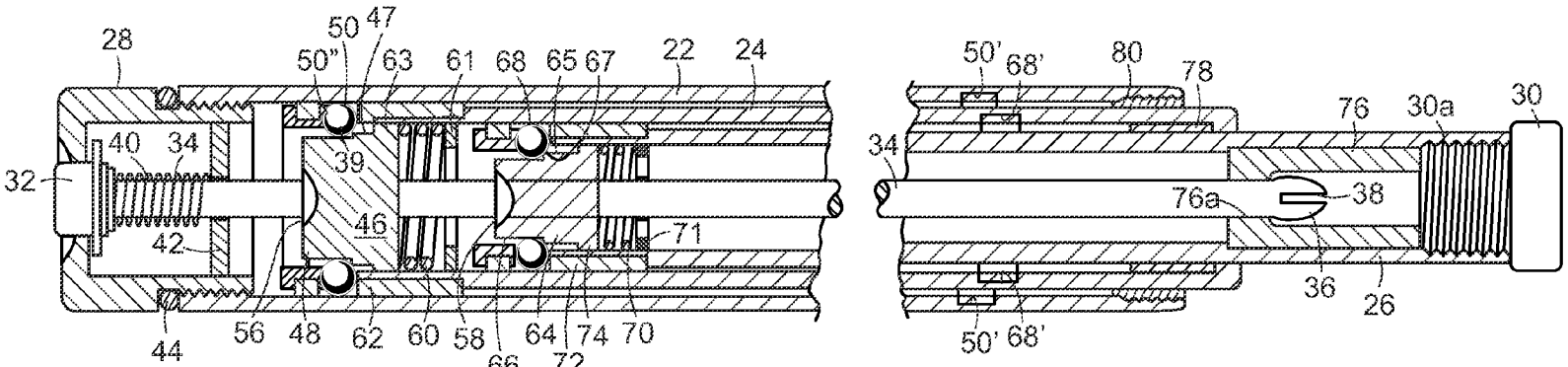
FIG. 2 is a cross-sectional view of a push button release baton of the prior art, namely the baton of U.S. Pat. No. 6,238,292 ('292).

As described above, FIGS. 1 and 2 illustrate prior art designs of push button release police batons. FIG. 1 shows the '447 baton which employs a long release rod having two cam surfaces which allow the locking members to retract and permit the baton sections to collapse. FIG. 2 shows the '292 baton which employs a long release rod which releases ball bearing locking mechanisms to allow the baton sections to collapse.

Embodiments of the present invention are illustrated in FIGS. 3-12. The present invention uses neither ball bearings nor a long release rod having two cam surfaces to allow the baton sections to collapse.

Figure 3:
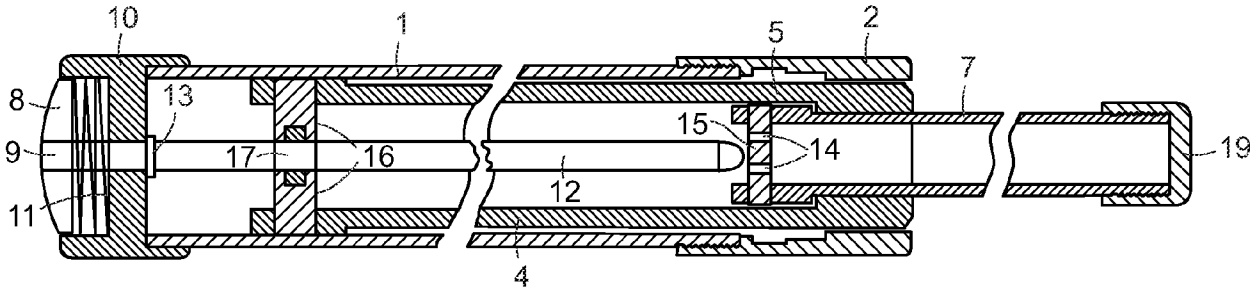
FIG. 3 is cross-sectional view of an embodiment of a push button release baton of the present invention.

FIG. 3 is cross-sectional view of an embodiment of a push button release baton of the present invention. The remaining Figures illustrate an alternative embodiment of a push button release baton of the present invention and details regarding the clutch locking mechanisms employed herein.

In the illustrated embodiments of the invention, three baton sections are locked in place by two clutch locking mechanisms located near the junctions of the baton sections. If the baton had only two sections, only one clutch locking mechanism would be required. Likewise, if the baton had more than three sections, additional clutch locking mechanisms would be required.

Figure 4:
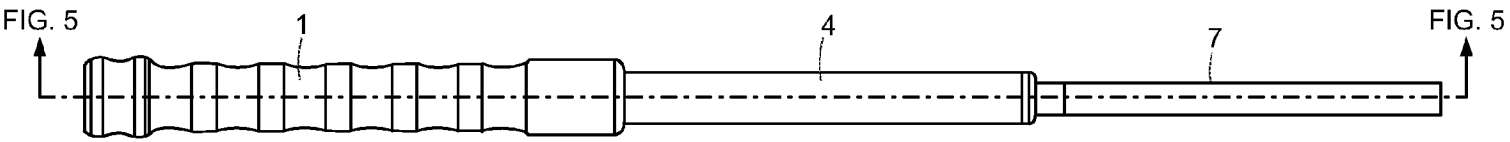
FIG. 4 is a side view of an embodiment of a push button release baton of the present invention.
Figure 5:
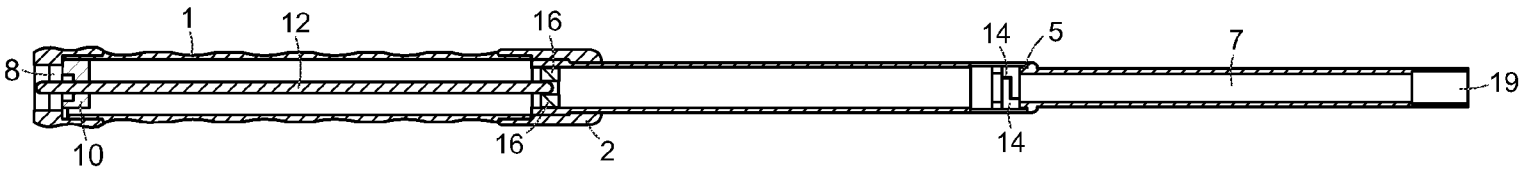
FIG. 5 is cross-sectional view of the push button release baton illustrated in FIG. 4 (Section A-A).

As illustrated in FIGS. 3, 4, and 5, a baton of the present invention includes the following component parts; handle frame (1), handle nose guide (2), middle frame (4), middle nose guide (5), small frame (7), end cap (8), baton release button (9), end cap bushing (10), end cap spring (11), clutch alignment rod (12), end cap retaining clip (13), two small clutches (14), two small clutch springs (15), two middle clutches (16), two middle clutch springs (17), and baton tip (19).

Figure 6A:
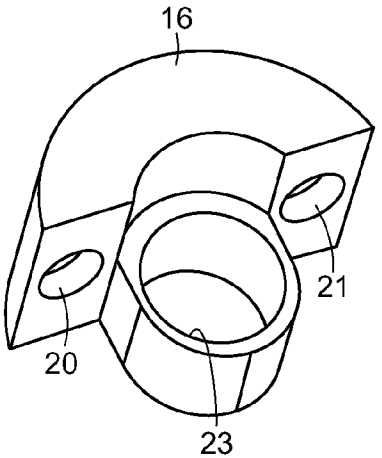
FIGS. 6A and 6B show one half of the large (6A) and small (6B) clutch locking mechanisms employed in a baton of the present invention.
Figure 6B:
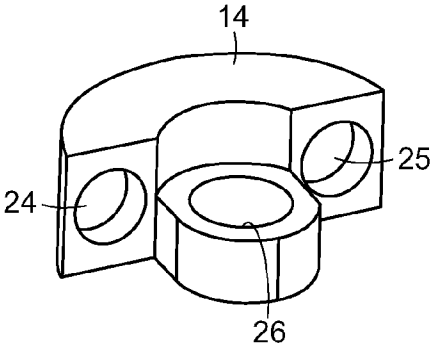

FIGS. 6A and 6B illustrate preferred embodiments of the clutch locking mechanisms employed in the baton of the present invention. FIG. 6A shows one of the two identical halves of the middle clutch locking mechanism (16) employed to hold the middle frame (4) to the handle frame (1) of the baton. Also shown in this drawing are two of the spring detents (20) and (21), as well as the alignment hole (23). FIG. 6B shows one of the two identical halves of the small clutch locking mechanism (14) employed to hold the small frame (7) to the middle frame (4) of the baton. Also shown in this drawing are two of the spring detents (24) and (25), as well as the alignment hole (26).

Figure 7B:
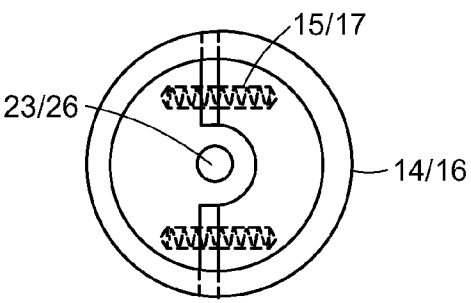
FIGS. 7A, 7B and 7C show how the clutch locking mechanisms operate; fully open before assembly (7A), fully closed for release (7B) and partly expanded (7C) for locking the baton segments.
Figure 7C:
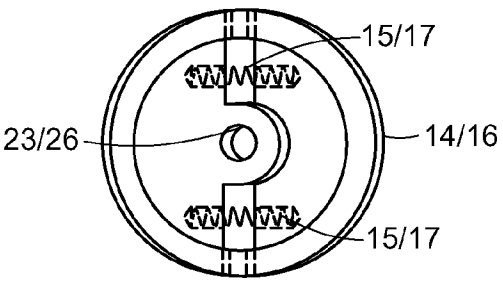
Figure 7A:
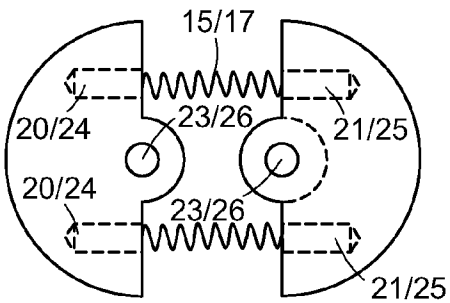

FIGS. 7A, 7B and 7C illustrate the clutch locking mechanism employed in each of the stages of the baton of the present invention. FIG. 7A shows the clutch locking mechanism in an expanded position, showing the two clutch locking pieces (14 or 16) and the two clutch springs (15 or 17) which force the clutch locking mechanism to expand when in the locking position. FIG. 7B shows the clutch locking mechanism in the collapsed or unlocking position, with the two alignment holes (23 or 26) in alignment. FIG. 7C shows the clutch locking mechanism in the locking position, with the two alignment holes (23 or 26) out of alignment.

Figure 11:
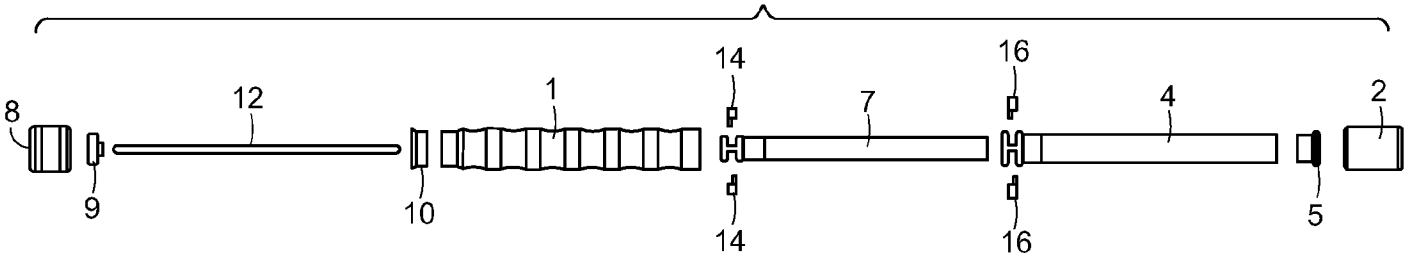
FIG. 11 illustrates an expanded view of an embodiment of a push button release baton of the present invention.
Figure 12:
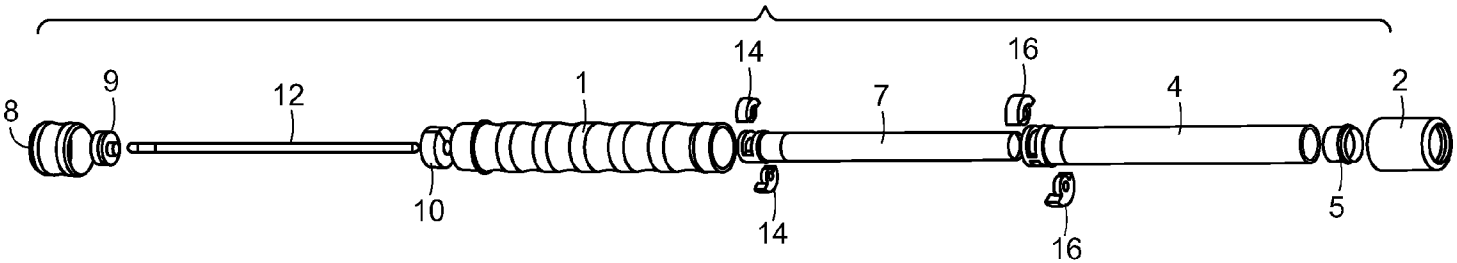
FIG. 12 illustrates an expanded view of an embodiment of a push button release baton of the present invention.

As illustrated in FIGS. 11 and 12, the clutch locking pieces (14 or 16) are loaded into the perpendicular clutch slots (29 or 30) in the middle (4) and small (7) frames, with one clutch turned 180 degrees and resting on top of the other. It will be noted that several small parts are omitted from these two drawings, to better illustrate the assembly of the major baton components. These parts are shown in other drawings and are discussed in relationship thereto.

As illustrated in FIGS. 6A, 6B, 7A, 7B, and 7C, each clutch locking piece (14 or 16) includes a center alignment hole (23 or 26) that lines up with the center line of the respective frame shaft. Each clutch locking piece (14 or 16) also contains spring detents (20 or 24) to house the clutch springs (15 or 17). As these clutch locking pieces are loaded into the clutch slots (29 or 30), the two clutch springs (15 or 17) are installed. When each clutch locking piece (14 or 16) is flush with the outside surface of the frame shaft (4 or 7) the clutch springs (15 or 17) are in compression as shown in FIG. 7B. These assemblies can then be placed onto the clutch alignment rod housed in the end cap.

The clutch alignment rod (12) keeps the alignment holes (23 or 26) in the clutch locking pieces (14 or 16) perfectly aligned and the clutch locking pieces in the flush position. The successively smaller tubular frames are loaded into one another, the small frame (7) inside the middle frame (4) and the middle frame (4) inside of the handle frame (1). The clutch alignment rod (12) holds both of the clutch locking assembly members (14 and 16) in the flush closed position. The length of the alignment rod (12) is critical for the function of this operating mechanism.

As shown in FIGS. 3, 4, 5, 8A, 9A, and 10, the baton sections are all tubular shafts that are sized and shaped to telescope inwardly and outwardly relative to the tubular shaft of the handle section of the baton.

Figure 8A:
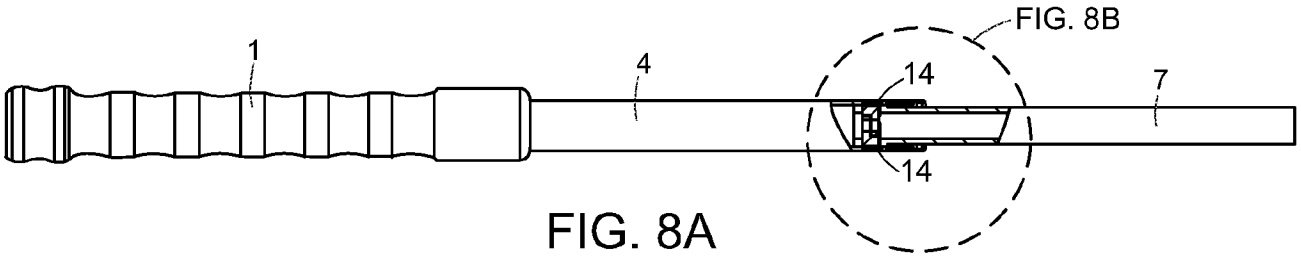
FIGS. 8A and 8B show a section of the outer (small) clutch locking mechanism employed in a baton of the present invention.
Figure 8B:
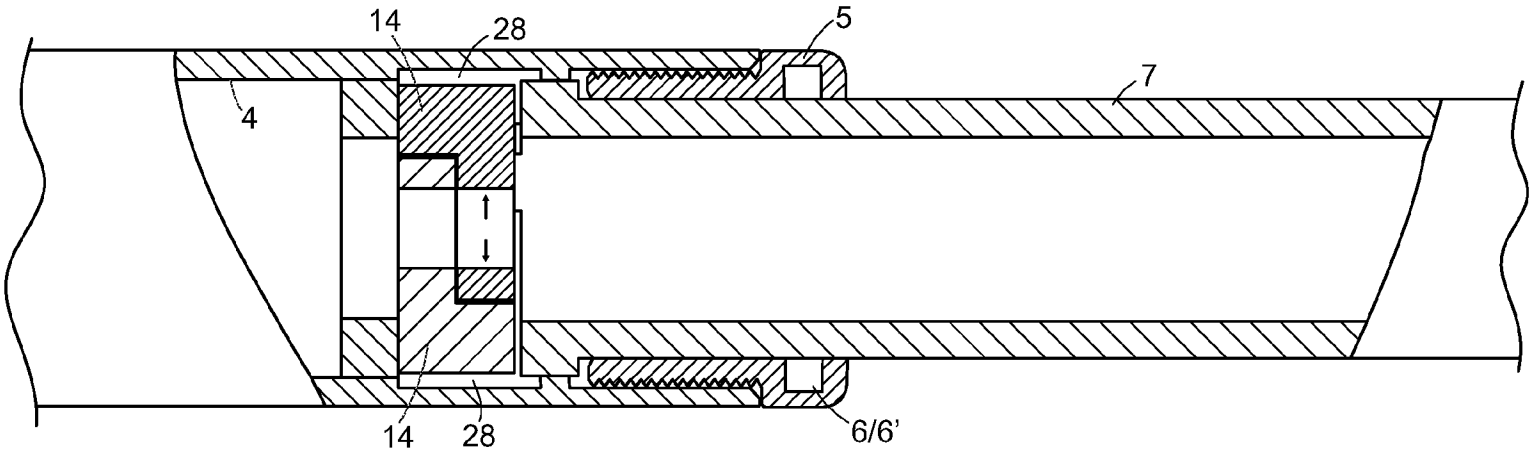
Figure 9A:
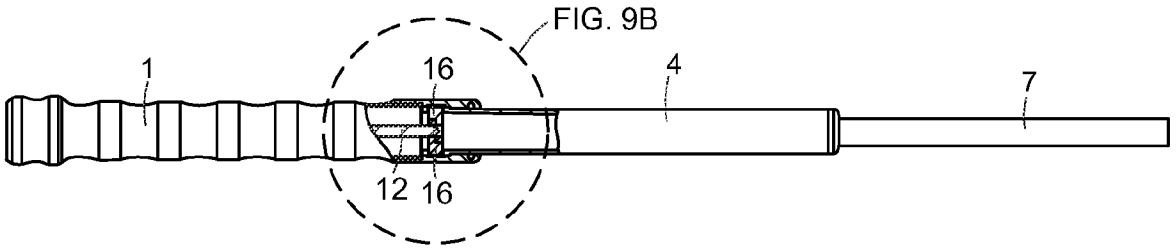
FIGS. 9A and 9B show a section of the inner (large) clutch locking mechanism employed in a baton of the present invention.
Figure 9B:
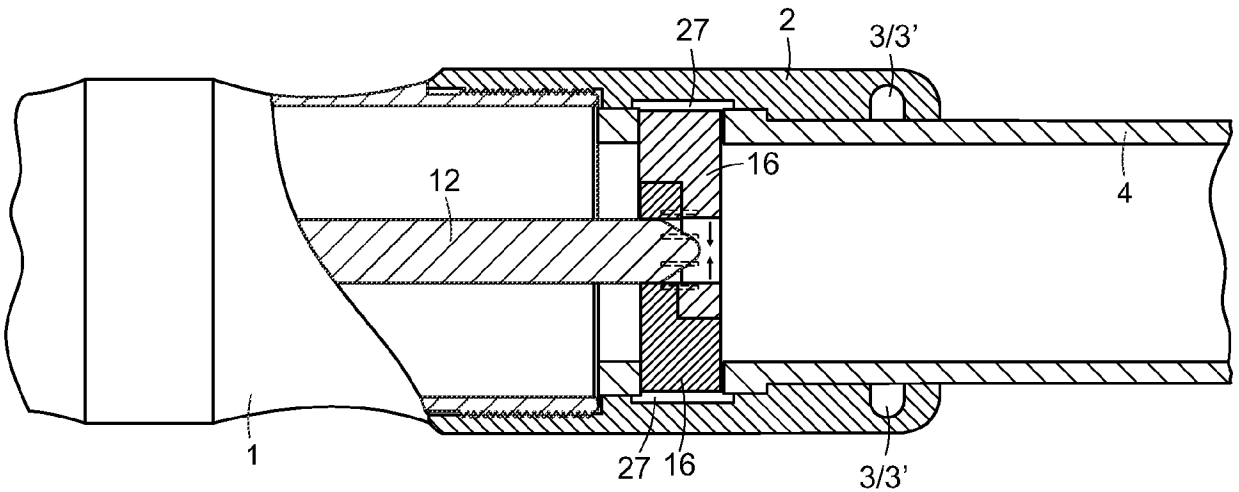

As shown in FIGS. 8B and 9B, the outward ends of the middle and small baton sections both include clutch locking slots (or grooves) formed on their interior surfaces. These middle and small clutch locking slots (or grooves) are slightly larger than the width of the respective middle and small clutch locking pieces for each baton section. The clutch slots are formed (e.g., cut) perpendicular to the long axis (length) of the tubular shafts. These clutch locking slots house and retain the respective middle and small clutch locking pieces, when the middle and small baton shafts come into their fully extended positions.

As illustrated in FIGS. 8B and 9B, the handle frame (1) and the middle frame (4) each have an internal groove or clutch slot (27) and (28), each having a depth sufficient to allow the clutch locking pieces to lock into the inner diameter of each of the shafts. The clutch locking pieces in each of the middle frame (4) and the small frame (7) work in the same manner although they are of different sizes.

When the baton is expanded the small frame (7) and the middle frame (4) expand outwardly in a telescoping manner from the handle frame (1) until each frame contacts a step provided at the end of the outer tube (27 or 28), so as to not allow separation of the respective frame shafts. In FIG. 8B, the two arrows show the direction that the clutch locking pieces (14) will move, i.e., into the internal groove or clutch slots (28) to lock the baton frames.

The clutch alignment rod is coupled to the release button for movement therewith and a spring and a platform supported by the rear cap, e.g., by welding, threading, press fit, bonding, retaining or snap ring, or the like. The spring forces the release button to project outwardly from the rear cap. An optional O-ring may be provided between the threaded rear cap and the first tubular section.

When the baton is in the fully extended configuration, the clutch alignment rod has a length that is just out of contact with the clutch locking member disposed in the middle clutch locking slot hole. When the release button on the end of the baton handle is depressed, the clutch alignment rod is pushed into the center alignment holes of the clutch locking member, causing the locking member to collapse and disengage from the clutch locking slot. When the clutch locking members are in the disengaged position the central alignment holes in each clutch half are in line and round. When it is in the locked position the central alignment holes in each clutch half locking member are off-set. In FIG. 9B, the two arrows show the direction that the clutch locking pieces (16) will move, i.e., out of the internal groove or clutch slots (27) to unlock the baton frames.

Once released, the middle frame or section of the baton can then be collapsed into the handle frame or section of the baton. As the middle frame telescopes back into the handle frame, the small frame or section moves toward the tip of the clutch alignment rod and the rod performs the same alignment and release function as done in the middle section. The rod forces the two clutch locking pieces together, aligning the alignment holes, thereby bringing the surface of the clutch locking pieces flush with the small section allowing the shaft to bypass the locking grove and travel into the middle section.

To cause the collapse of the baton sections into one another, the push button on the handle end section is depressed to cause the axially positioned clutch alignment rod to bring the two clutch pieces into full alignment via the alignment holes, which causes the release of the first (middle) clutch locking mechanism holding the middle section and allows it to telescope back into the larger handle end section. While the middle section is telescoping into the larger diameter handle end section, the tip of the axially positioned clutch alignment rod next contacts the two small clutch pieces and likewise brings them into full alignment, thereby allowing the second (small) clutch locking mechanism holding the smaller baton section in place relative to the middle section to be released, so that the smaller end section may telescope into the middle section.

Figure 10:
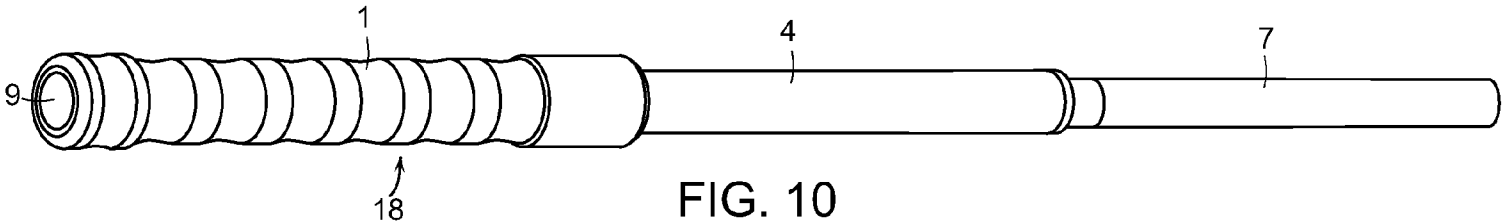
FIG. 10 illustrates an embodiment of a push button release baton of the present invention, showing the handle end and the push button. The tip is not shown here.

As illustrated in the Figures, the parts connected to the baton sections, namely the tubular handle section, the second (or middle) tubular section, the third (or small) tubular section, are all designed to telescopically extend or collapse with one another. The inner and outer diameters of the tubular sections selected to permit movement of the sections. A rear cap is provided, which may be threaded to the handle section as illustrated. An end tip is provided which can be threaded to the small shaft as shown in FIG. 3, or mounted internally as shown in FIG. 5. The external tip may be coated in an elastic or plastic material, such as rubber, Plastisol, or other similar materials well known in the art, in order to protect against unintended injury. A release button is provided at the base of the handle cap as shown in FIGS. 3 and 10. This button is depressed by the user to permit the baton to collapse from the extended position as shown in FIGS. 4, 5 and 10.

Additional Design Options (a) The baton shafts can rotate when locked. A straight knurl can be added to both the outside of the clutch surface and inside of the locking groove to act like a spline control.

(b) Machined nose pieces can be used for the handle and middle sections, and if provided with an O-ring to tighten the fit, would eliminate potential rattle of the baton tubular sections.

(c) Finger grooves can be employed in the handle to provide extra gripping and control either on a knurled metal surface or under a form fitted rubber grip rubber over finger locks.

(d) Closed position—tension on the I.D. of the rod clutches holds the baton closed. Outward pressure from the clutch springs push the center holes against the clutch alignment rod would allow the baton to readily stay in the closed position.

(e) Ceramic tip—the tip of the baton can be modified if desired; such as to form a ceramic tip. A ceramic coating would be hard enough to break the surface tension of window glass (automotive, safety glass, and the like) without the need to have a sharp tip as with other window breakers on the market. The standard metal tip on the baton would be heat treated and then a ceramic coating would then be deposited thereon using conventional techniques. A ceramic tip would be desirable because of the improved hardness imparted to the tip. There are other coatings used, for example on tooling, such as tin and the like, which would alter the appearance of the baton. These could be employed if desired.

Baton Example

The following parts are assembled into a preferred three stage baton of the present invention; (a) a tubular handle baton section; (b) a tubular middle baton section; (c) a tubular small end baton section; (d) two middle clutch locking pieces with middle clutch springs; (e) two small clutch locking pieces with small clutch springs; (f) a push button end cap member, and an end cap spring; (g) a clutch alignment rod; and (h) a baton tip end member. See FIG. 3.

Baton Assembly Procedure:

Step A—Thread the handle nose guide (2) onto the baton handle frame (1).

Step B—Place the handle nose guide O-ring (3) into the O-ring groove (3') located in the I.D. of the nose guide. See FIG. 9B.

Step C—Install the handle frame grip (18) on the exterior surface of the handle frame (1).

Step D—Thread the middle nose guide (5) into the middle frame (4).

Step E—Place the middle nose guide O-ring (6) into the middle nose guide O-ring groove (6') located on the I.D. of the middle nose guide (5). See FIG. 8B.

Step F—Thread the baton release button (9) onto the threaded end of the clutch alignment rod (12). See FIGS. 5, 11 and 12.

Step G—Place the end cap spring (11) over the exposed end of the clutch alignment rod (12) until it contacts the bottom of the release button (9).

Step H—Place the end cap bushing (10) over the exposed end of the clutch alignment rod (12) and slide it up to the end cap spring (11).

Step I—Install the end cap retaining clip (13) onto the clutch alignment rod (12).

Step J—Combine two small clutches (14) each having a clutch alignment hole, with one clutch turned 180 degrees from the other, by installing two small clutch springs (15) into the detents (20) located on either side of the clutch pieces, thereby forming the small clutch assembly which includes two clutch alignment holes (23). See FIGS. 6A, 6B, 7A, 7B and 7C.

Step K—Slide the small clutch pieces (14) into the clutch slots (29) in the small frame (7). See FIGS. 8B and 9B.

Step L—Using the clutch alignment rod (12) while holding the small clutch assembly (14) flush with the O.D. of the small frame (7); slide the clutch alignment rod (12) into the clutch alignment holes (23) to hold the small clutch assembly in place. See FIGS. 5, 9B and 11.

Step M—Slide the small frame (7) and small clutch assembly into the middle frame (4). Once the small clutch assembly (14) is inside the middle frame (4) the clutch alignment rod (12) can be removed and the I.D. of the middle frame (4) will retain the small clutch assembly (14). See FIG. 11.

Step N—Combine the two middle clutches (16), one turned 180 degrees from the other, and install two middle clutch springs (17) into the detents on either side of the clutch pieces, thereby forming the middle clutch assembly which includes two clutch alignment holes (26). See FIGS. 6A, 6B, 7A, 7B and 7C.

Step O—Slide the middle clutch assembly into the clutch slots (30) in the open end of the middle frame (4). See FIG. 11.

Step P—Using the clutch alignment rod (12) while holding the middle clutch assembly flush with the O.D. of the middle frame (4) slide the clutch alignment rod (12) into the middle clutch alignment holes to hold the middle clutch assembly in place. See FIGS. 5, 9B and 11.

Step Q—Slide the middle frame (4) and middle clutch assembly into the handle frame (1). Push the clutch alignment rod (12) assembly into the handle frame (1) until the end cap bushing (10) seats into the open end of the handle frame (1).

Step R—Install the end cap (8) on the open end of the handle frame (1).

Step S—Install the baton tip (2) on the open end of the small frame (7).

Although the invention has been shown and described with respect to exemplary embodiments thereof, various other changes, additions and omissions in the form and detail thereof may be made therein without departing from the spirit and scope of the invention.

What is claimed is:

1. A multi-stage push button release police baton comprising, in combination:

(a) a stationary tubular baton handle section;

(b) a moveable tubular baton middle section configured to telescopingly reciprocate within the handle section, having a first clutch locking groove;

(c) a first clutch locking mechanism comprising two opposing identical clutch locking pieces with alignment holes located therein;

(d) a moveable tubular baton end section configured to telescopingly reciprocate within the middle section, having a second clutch locking groove;

(e) a second clutch locking mechanism comprising two opposing identical clutch locking pieces with alignment holes located therein, wherein the second clutch mechanism is of smaller size than the first clutch locking mechanism;

(f) a clutch release rod with a smooth surface positioned axially in the handle section;

wherein when the baton sections are in an extended condition, one end of the clutch release rod is spaced from the first clutch mechanism such that the clutch release rod is free of engagement with the first clutch mechanism and the second clutch mechanism, and the clutch locking pieces are biased outwardly into the clutch locking grooves such that the alignment holes are axially offset;

wherein the clutch release rod is attached to an end cap member with a release button located on the outside of the end cap member; and wherein the release button can be depressed forcing the release rod into the axially offset alignment holes in the clutch locking pieces drawing the alignment holes toward axial alignment and pulling the clutch locking pieces from the clutch locking grooves in each baton section, thereby releasing the clutch locking mechanisms.

2. The baton of claim 1, wherein when the release button is depressed the clutch release rod first engages the first clutch locking mechanism to move the first clutch locking pieces out of alignment with the first clutch locking groove and then engages the second clutch locking mechanism to move the second clutch locking pieces out of alignment with the second clutch locking groove.

3. The baton of claim 2, wherein at least one of the baton tubular members is made from metal tubing.

4. The baton of claim 3, wherein at least one of the baton tubular members is made from steel tubing.

5. The baton of claim 4, wherein the steel tubing is an alloy steel.

6. The baton of claim 5, wherein the steel alloy is 4130 steel.

7. The baton of claim 6, wherein the steel is hardened to 38 to 52 on the Rockwell C Scale.

8. The baton of claim 1, wherein at least one of the baton tubular members is made from aluminum tubing.

9. The baton of claim 8, wherein the aluminum is 6061-T6.

10. The baton of claim 8, wherein the aluminum is 7075.

11. The baton of claim 1, wherein at least one of the baton tubular members is made from plastic tubing.

12. The baton of claim 1, wherein the first clutch locking groove forms a complete circle inside the baton middle section, and the second clutch locking groove forms a complete circle inside the baton end section, and whereby at least one of the baton sections can rotate when locked.

13. The baton of claim 12, further comprising a straight knurl added to an outside of both of the clutch locking members to act as a spline control.

14. The baton of claim 1, wherein a machined nose piece can be used with the handle section.

15. The baton of claim 1, wherein finger grooves are present in the handle section to provide extra gripping.

16. The baton of claim 1, further comprising a ceramic tip.

17. The baton of claim 1, further comprising a coated tip.

18. The baton of claim 17, wherein the tip coating is a metal that alters the appearance of the baton.

19. The baton of claim 18, wherein the tip coating comprises tin.

* * * * *